US008973711B2

(12) United States Patent
Hayman

(10) Patent No.: US 8,973,711 B2
(45) Date of Patent: Mar. 10, 2015

(54) INTERMEDIATE SCAFFOLD JOINT

(75) Inventor: Yates Westley Hayman, Walker, LA (US)

(73) Assignee: Deltak Manufacturing, Inc., Walker, LA (US)

( * ) Notice: Subject to any disclaimer, the term of this patent is extended or adjusted under 35 U.S.C. 154(b) by 529 days.

(21) Appl. No.: 12/872,689

(22) Filed: Aug. 31, 2010

(65) Prior Publication Data

US 2012/0048649 A1 Mar. 1, 2012

(51) Int. Cl.

| | |
|---|---|
| ***E04G 1/00*** | (2006.01) |
| ***E04G 7/30*** | (2006.01) |
| ***E04G 7/14*** | (2006.01) |
| ***E04G 7/22*** | (2006.01) |

(52) U.S. Cl.

CPC *E04G 7/304* (2013.01); *E04G 7/14* (2013.01); *E04G 7/22* (2013.01)

USPC ..... 182/186.8

(58) Field of Classification Search

CPC ..... E04G 7/14; E04G 7/305; E04G 7/307; E04G 5/00; F16B 7/0493

USPC ..... 182/186.7, 186.8, 179.1

See application file for complete search history.

(56) References Cited

U.S. PATENT DOCUMENTS

| | | | | | |
|---|---|---|---|---|---|
| 2,195,906 | A | * | 4/1940 | Uecker et al. | 52/651.1 |
| 2,392,932 | A | | 1/1946 | Macbeth | |
| 2,506,640 | A | | 5/1950 | Hawes | |
| 2,679,413 | A | * | 5/1954 | Johnson | 403/385 |
| 2,743,657 | A | * | 5/1956 | Kriegbaum | 403/395 |
| 2,842,408 | A | * | 7/1958 | Symons | 52/645 |
| 3,105,667 | A | * | 10/1963 | Bauer | 248/499 |
| 3,213,964 | A | * | 10/1965 | Tucker et al. | 182/119 |
| 3,458,222 | A | * | 7/1969 | Juculano | 403/49 |
| 3,870,124 | A | * | 3/1975 | Howard | 182/178.5 |
| 3,902,817 | A | | 9/1975 | Meir | |
| 4,445,307 | A | * | 5/1984 | Puccinelli et al. | 52/638 |
| 4,586,842 | A | * | 5/1986 | Puccinelli | 403/246 |
| 4,632,221 | A | * | 12/1986 | Stanford | 182/186.8 |
| 4,948,289 | A | * | 8/1990 | Dellinger | 403/246 |
| 4,967,878 | A | * | 11/1990 | Adams | 182/186.8 |
| 5,040,916 | A | * | 8/1991 | Morgan | 403/387 |
| 5,078,532 | A | * | 1/1992 | Williams | 403/246 |
| 6,168,345 | B1 | * | 1/2001 | Legge | 403/385 |
| 6,786,302 | B2 | | 9/2004 | Liew et al. | |
| 6,789,649 | B2 | | 9/2004 | Herrmann | |
| 6,932,195 | B1 | * | 8/2005 | Hayman et al. | 182/178.1 |
| 6,994,187 | B1 | * | 2/2006 | Hensley et al. | 182/178.1 |
| 7,806,623 | B2 | * | 10/2010 | Thomke et al. | 403/385 |
| 7,971,686 | B1 | * | 7/2011 | Hayman | 182/186.8 |
| 7,975,803 | B2 | * | 7/2011 | Schwoerer | 182/178.1 |

(Continued)

OTHER PUBLICATIONS

Modern Language Association (MLA): "joint." Dictionary.com Unabridged. Random House, Inc. Jan. 1, 2013. <Dictionary.com http://dictionary.reference.com/browse/joint>.*

*Primary Examiner* — Katherine Mitchell
*Assistant Examiner* — Candace L Bradford
(74) *Attorney, Agent, or Firm* — Jones Walker LLP

(57) ABSTRACT

An improved intermediate scaffold joint comprising a frame, a first mounting member, a second mounting member, and a vertical stub. The frame has an interior side, an exterior side, and a top side. Both the first mounting member and the second mounting member are attached to the frame's exterior side for securing the frame to an existing scaffold structure. A vertical stub is attached to the frame's top side for attaching an intermediate vertical scaffold member to the frame.

10 Claims, 11 Drawing Sheets

(56) References Cited

U.S. PATENT DOCUMENTS

| | | | | |
|---|---|---|---|---|
| 8,132,649 | B2 * | 3/2012 | Rogers | 182/178.6 |
| 8,162,557 | B2 * | 4/2012 | Van Zile et al. | 403/96 |
| 8,206,052 | B1 * | 6/2012 | Hayman | 403/49 |
| 8,523,923 | B2 * | 9/2013 | Thomke et al. | 606/324 |
| 2002/0014371 | A1 * | 2/2002 | Krause | 182/186.8 |
| 2002/0092707 | A1 * | 7/2002 | Schwoerer | 182/179.1 |
| 2003/0015372 | A1 * | 1/2003 | Herrmann | 182/186.7 |
| 2003/0155180 | A1 * | 8/2003 | Liew et al. | 182/186.8 |

* cited by examiner

INTERMEDIATE SCAFFOLD JOINT

I. BACKGROUND

Scaffolds are temporary structures composed of vertical and horizontal members joined together to create a frame, which usually has an elevated working surface or decking. Generally, a scaffold frame comprises a series of joined vertical members that extend in an unbroken string until a desired work surface elevation is reached, generally positioned well above the ground. Horizontal members are used to not only stabilize the structure, but also to form work surfaces at desired elevations.

There are instances where it is desirable to attach intermediate scaffold members to the scaffold structure. An intermediate scaffold member is one which is not directly attached to the primary vertical members (i.e., the vertical members which extend to ground level). For instance, an access safety railing located at the working surface may need intermediate vertical members to properly define the railing. Additionally, there may be instances where it is desirable to attach an intermediate horizontal member to an existing horizontal member. These intermediate scaffold members are attached to the scaffold structure with an intermediate scaffold joint. Intermediate scaffold joints are typically attached to a primary horizontal scaffold member (i.e., an existing horizontal member). An intermediate horizontal member and an intermediate vertical member can then be attached to the joint.

The addition of intermediate vertical scaffold members to the scaffold structure can present problems due to the intermediate scaffold joint's ability to rotate about its attachment point with the existing horizontal member. A previous attempt to address this problem is shown in FIG. 1. This prior art joint 40 features two protrusions 43 which are engaged by a latch mechanism 44 attached to the end of the intermediate horizontal member 52. To install an intermediate vertical member 45 to the joint shown in FIG. 1, the intermediate horizontal member 52 must first be attached to the joint 40 to prevent the joint 40 from rotating. The device described in U.S. Pat. No. 6,932,195 functions in a similar manner, except that the latch mechanism has been replaced with a clamp, thereby providing an intermediate scaffold joint with universal applicability.

Therefore, it is an object of this invention to provide an improved intermediate scaffold joint which does not require the attachment of an intermediate horizontal member to prevent undesired rotation.

II. SUMMARY

An improved intermediate scaffold joint having features of the present invention comprises a frame, a first mounting member, a second mounting member, and a vertical stub. The frame has an interior side, an exterior side, and a top side. Both the first mounting member and the second mounting member are attached to the frame's exterior side for securing the frame to the existing scaffold structure. A vertical stub is attached to the frame's top side for attaching an intermediate vertical scaffold member to the frame.

In an embodiment of the present invention, the intermediate scaffold joint can also feature a means for attaching an intermediate horizontal scaffold member to the frame's interior side. The means for attaching an intermediate horizontal scaffold member can be one or more projections, a clamp, or any other means for attaching an intermediate horizontal scaffold member to the frame.

In another embodiment of the present invention, the first mounting member can be a latch, and the second mounting member can be a channel bracket. The latch is attached to the frame and functions to attach and secure the intermediate scaffold joint to a first primary horizontal scaffold member. The channel bracket is adapted to receive a second horizontal scaffold member. In an alternative embodiment, both the first and second mounting members can be latches. In a further alternative embodiment, both the first and second mounting members can be channel brackets.

In another embodiment of the present invention, an improved intermediate scaffold joint having features of the present invention comprises a frame, a latch, and a means for attaching an intermediate scaffold member to the frame. The attachment means can be for attaching either an intermediate horizontal member or an intermediate vertical member. In a preferred embodiment, the intermediate scaffold joint features an attachment means for both an intermediate horizontal member and an intermediate vertical member.

The above summary is not intended to describe each illustrated embodiment or every possible implementation. These and other features, aspects, and advantages of the present invention will become better understood with regard to the following description, appended claims, and accompanying drawings.

III. BRIEF DESCRIPTION OF THE DRAWINGS

IV. DESCRIPTION

Figure 1:
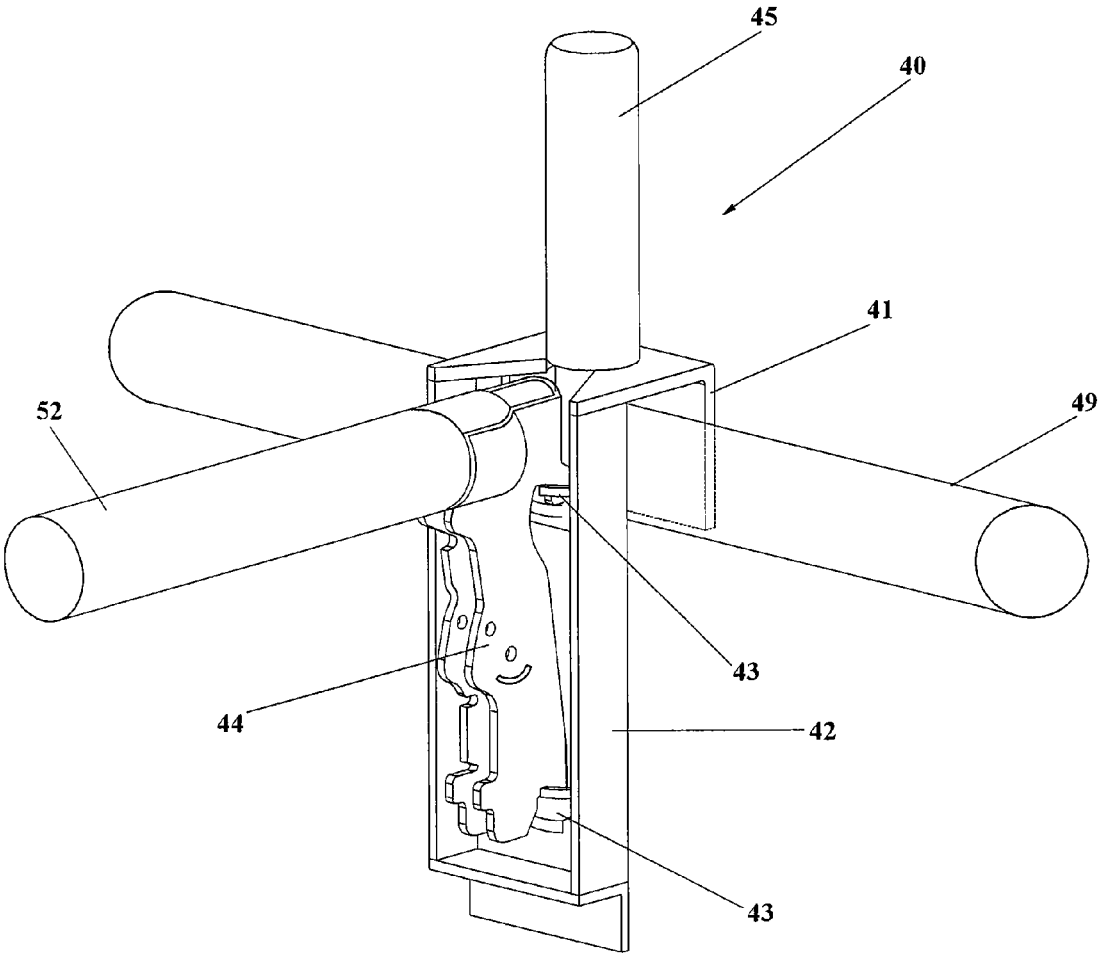
FIG. 1 (Prior Art)
FIG. 1 depicts a prior art scaffold member joint.

FIG. 1 depicts a prior art intermediate scaffold joint 40 designed to work in scaffold systems where the horizontal scaffold members 52 terminate with a latch mechanism 44, such as disclosed in U.S. Pat. Nos. 5,028,164, 5,078,532, and 6,932,195, each of which are incorporated herein by reference (the "Williams Latch Mechanism"). The intermediate scaffold joint 40 features a bracket 41 attached to a frame 42. The bracket 41 and frame 42 form a three-sided channel structure which is adapted to receive a horizontal scaffold member 49. In operation, the joint's bracket 41 is placed over the horizontal scaffold member 49. In this arrangement, the horizontal scaffold member 49 will be positioned within the channel structure. An intermediate horizontal scaffold member 52 is then latched onto the joint's two protruding ½ cup members 43 via the latch mechanism 44. The latching of the intermediate horizontal scaffold member 52 to the joint 40 helps prevent the joint 40 from rotating about the horizontal scaffold member 49. An intermediate vertical scaffold member can then be mounted to the vertical stub 45. A pin 46 can be used to secure the intermediate vertical scaffold member to the joint 40.

Figure 2:
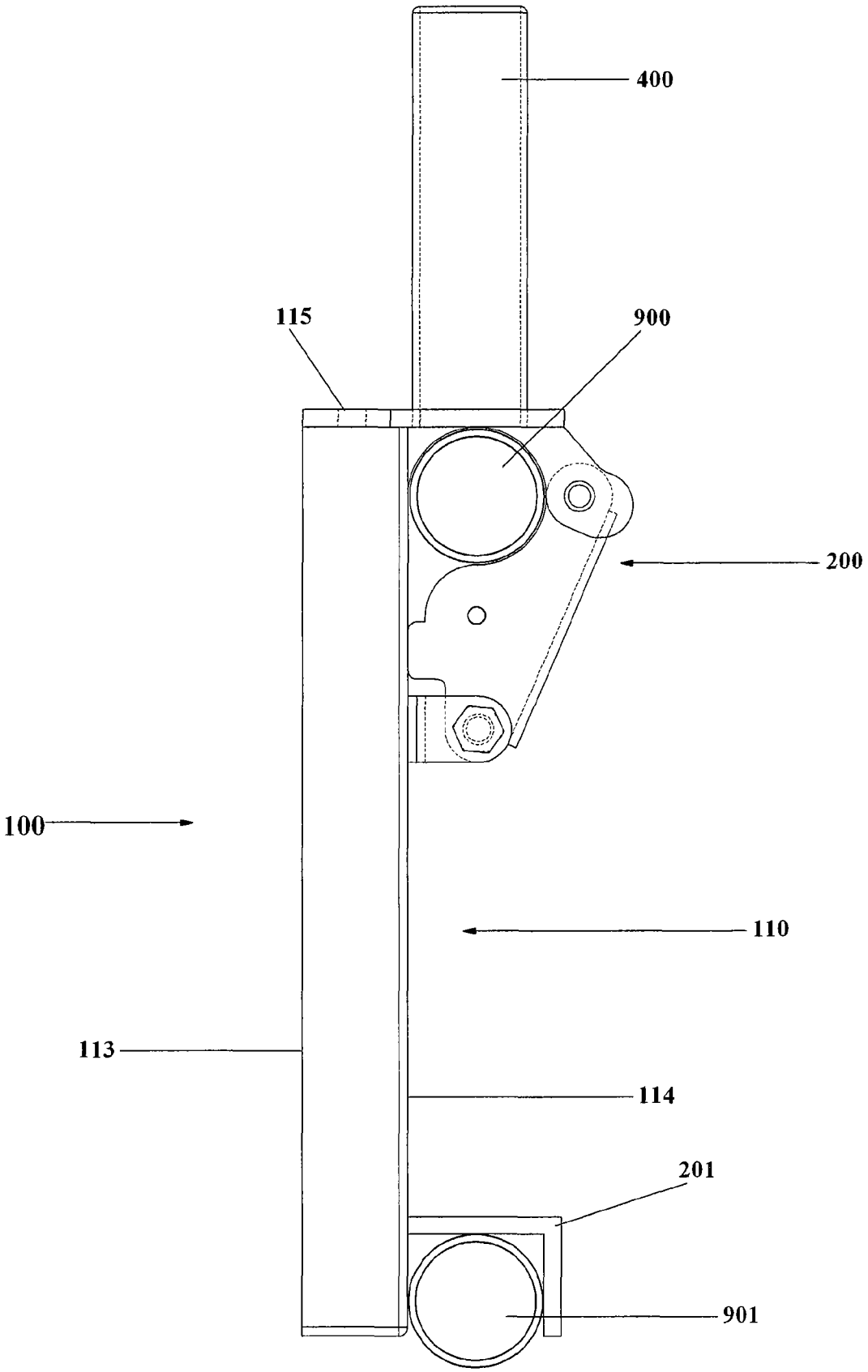
FIG. 2 is a right-side view of the preferred embodiment of the new intermediate scaffold joint.
Figure 3:
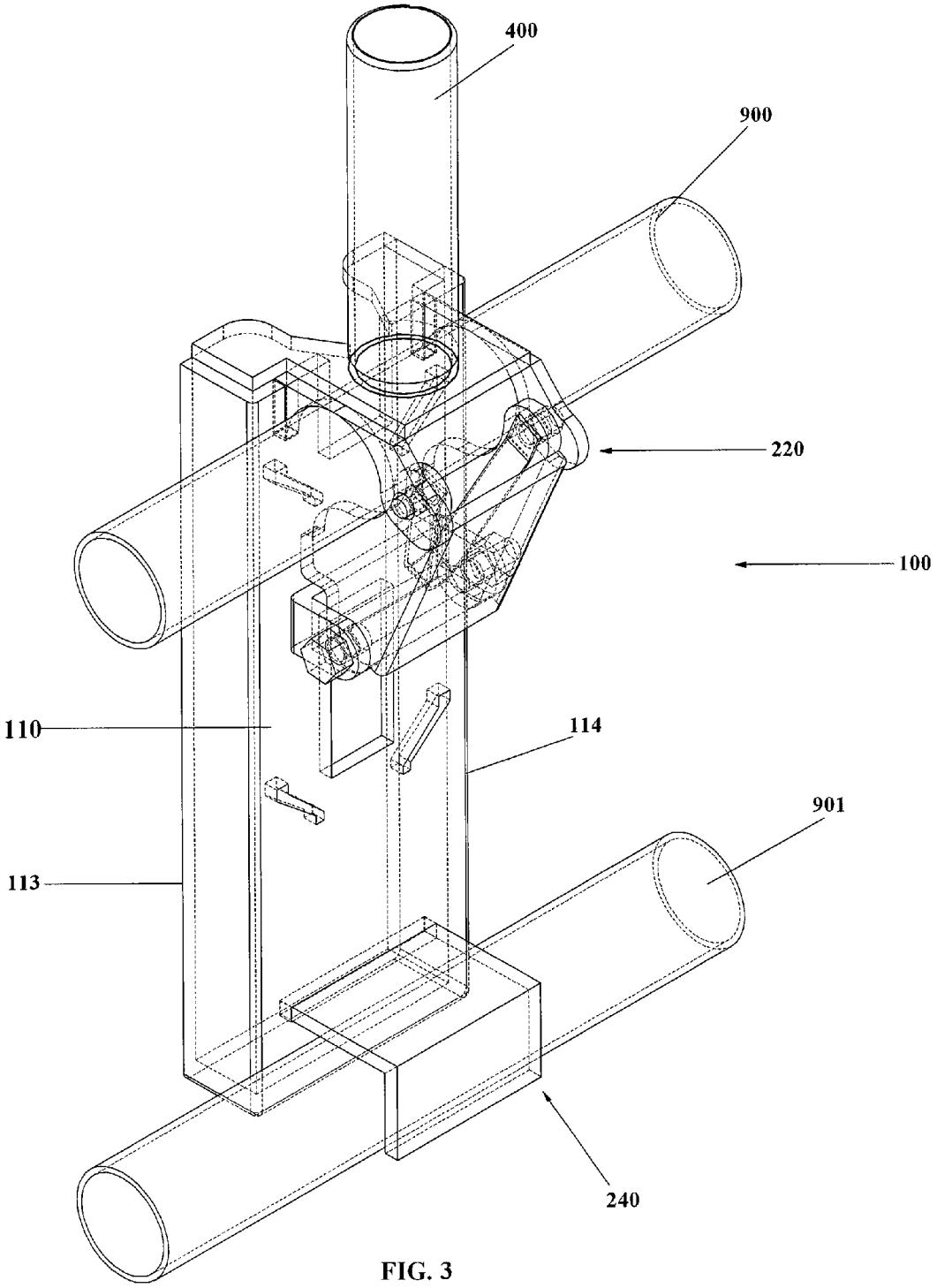
FIG. 3 is a rear perspective view of the preferred embodiment showing the features on the exterior side of the new intermediate scaffold joint.

A preferred embodiment of the new intermediate scaffold joint 100 is depicted in FIGS. 2-7. As shown in FIG. 2, the frame 110 has an interior side 113, an exterior side 114, and a top side 115. A first mounting member 200 is attached to the frame's exterior side 114 at a first position for securing the frame to a first primary horizontal scaffold member 900. A second mounting member 201 is attached the frame's exterior side 114 at a second position spaced apart vertically from the first position for securing the frame to a second primary horizontal scaffold member 901.

Figure 4:
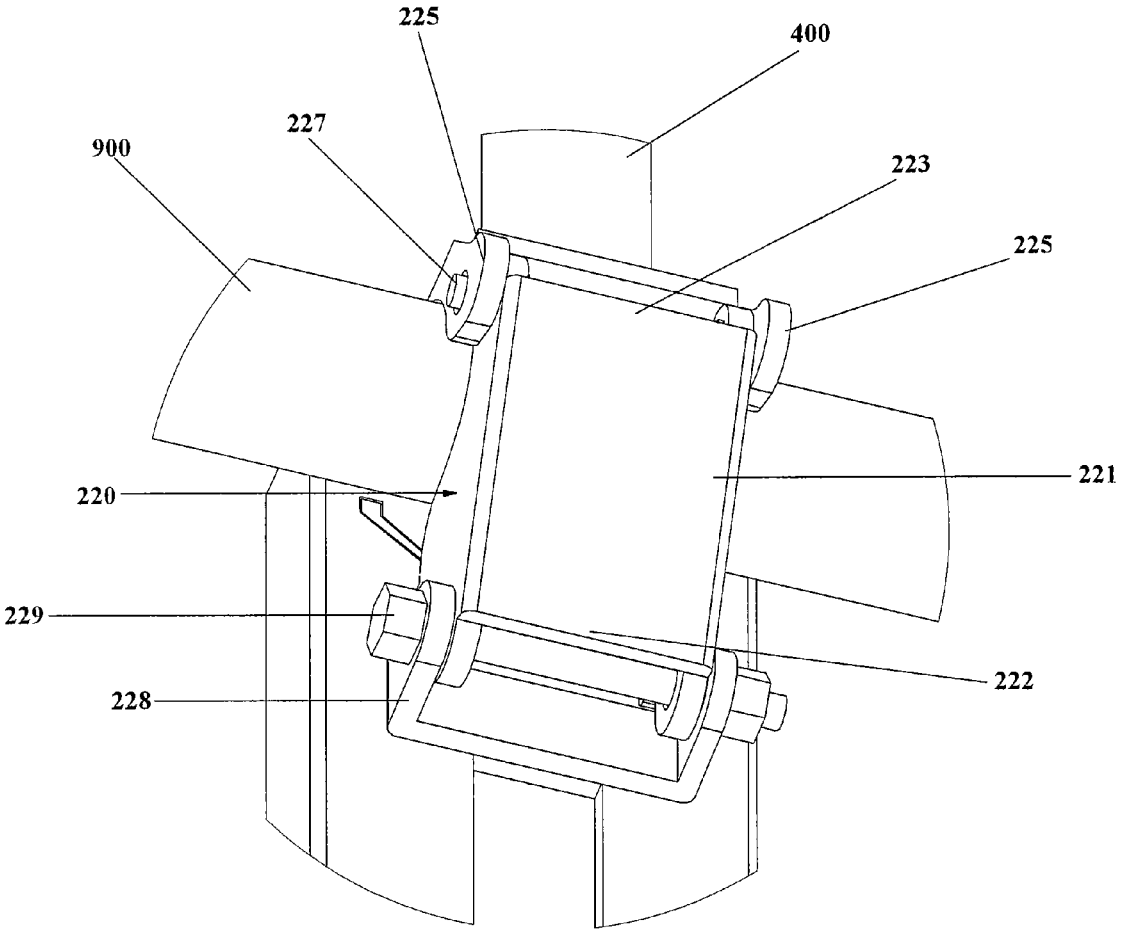
FIG. 4 is a perspective view of the intermediate scaffold joint's latch in the closed position.
Figure 5:
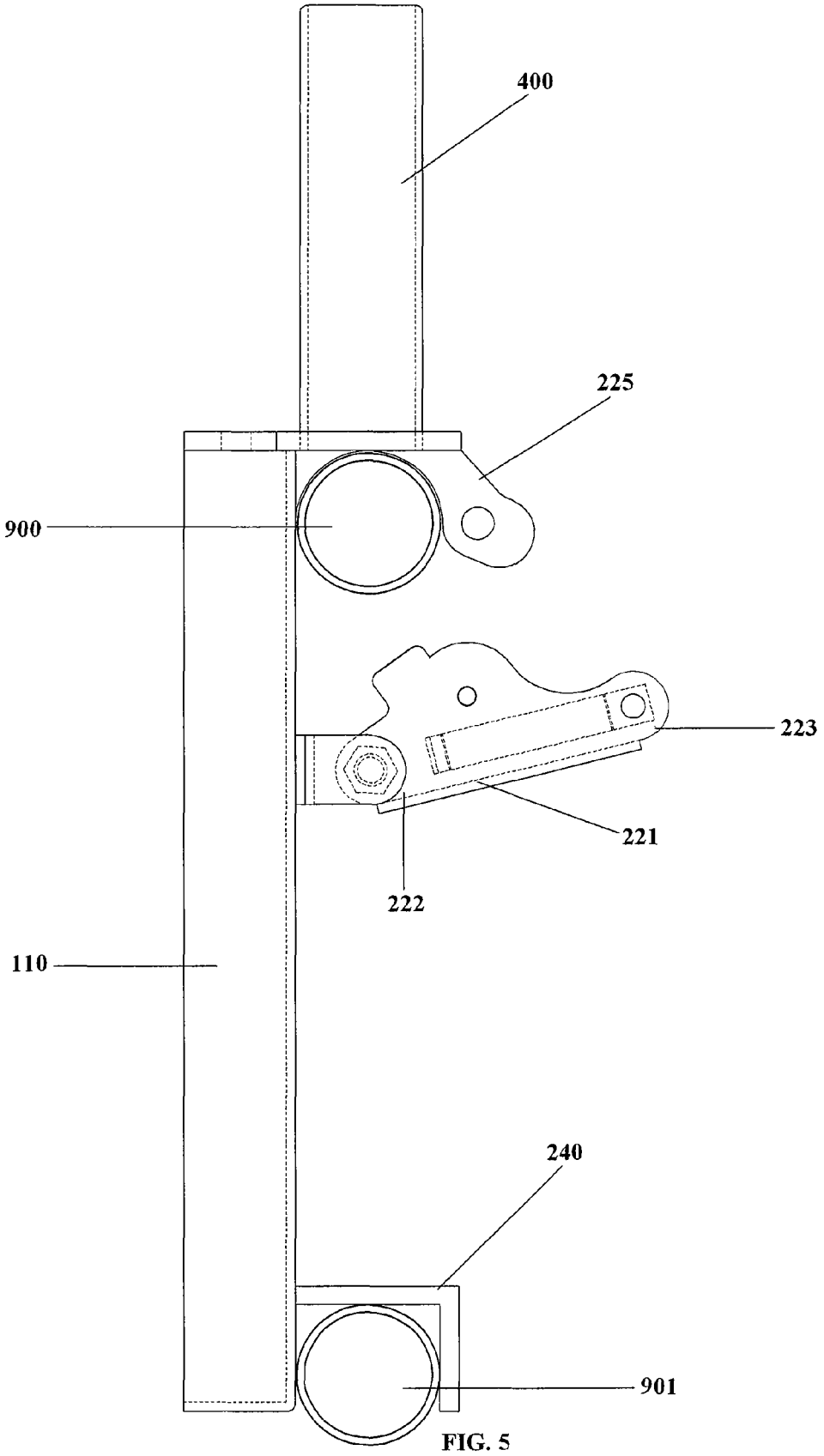
FIG. 5 is a perspective view of the intermediate scaffold joint's latch in the open position.
Figure 6:
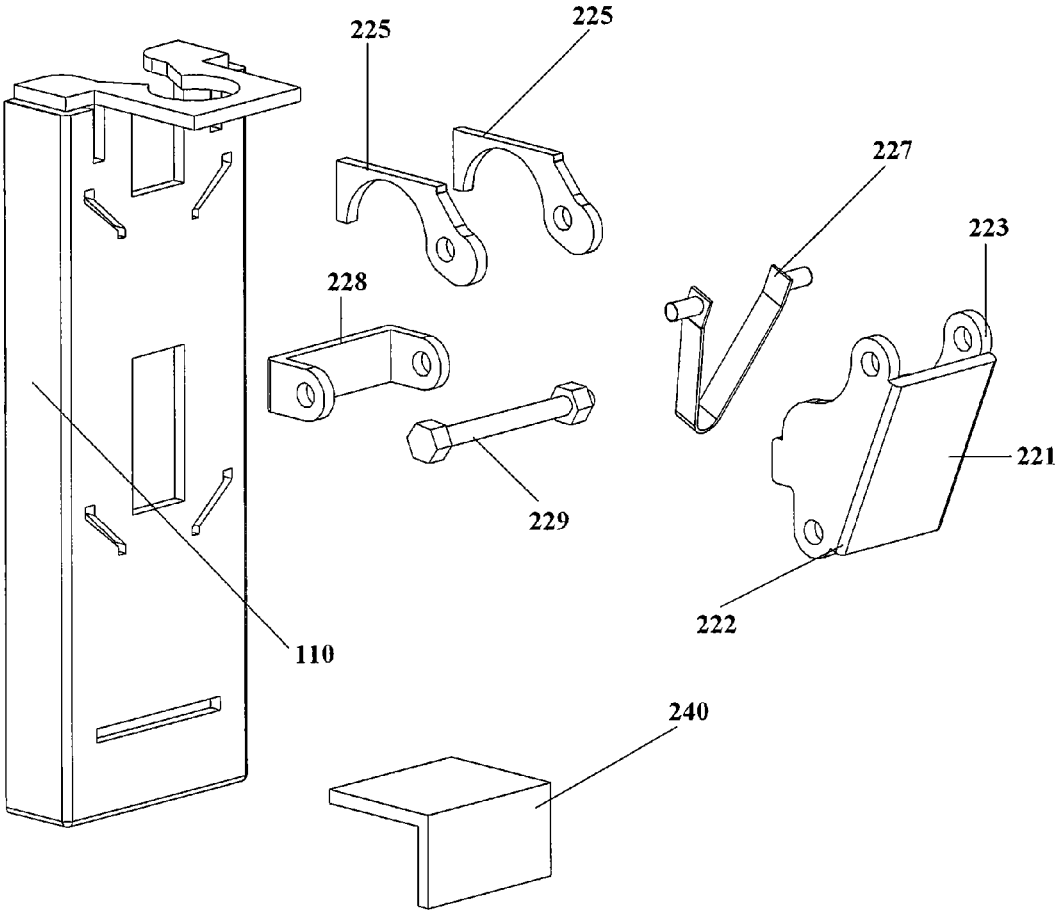
FIG. 6 is an exploded view of the intermediate scaffold joint's latch.
Figure 7:
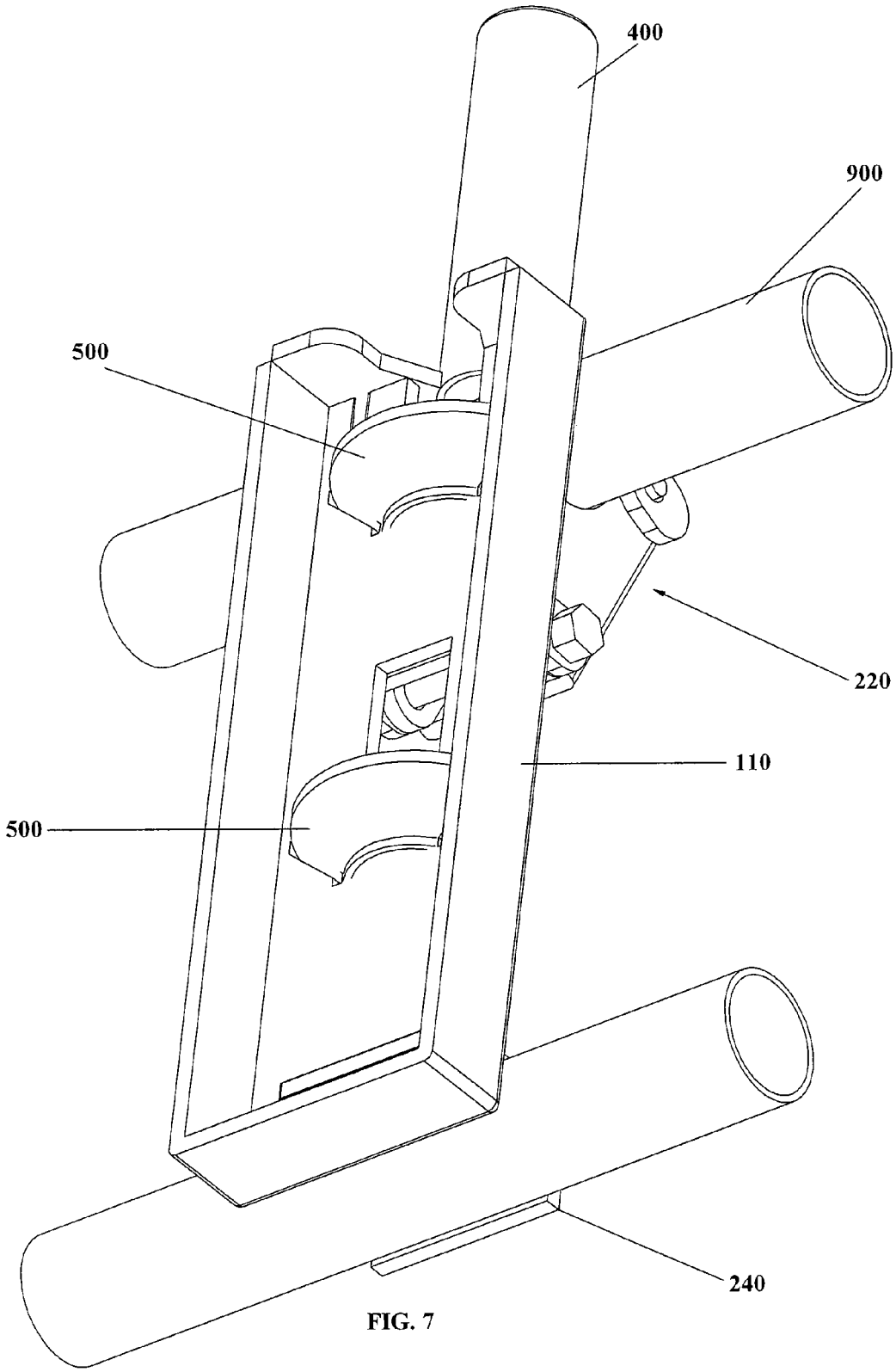
FIG. 7 is a front perspective view of the preferred embodiment showing the features on the interior side of the new intermediate scaffold joint.

In the embodiment shown in FIGS. 2-7, the first mounting member 200 is a latch 220. The latch 220 functions to secure the intermediate scaffold joint 100 to the first primary horizontal scaffold member 900. As shown in FIGS. 4-6, the latch 220 can comprise a movable member 221 and a fixed member 225. The fixed member 225 is fixedly attached to the frame 110. The fixed member 225 can be fixedly attached by welding, fasteners, or any other means known in the art. Alternatively, the fixed member 225 can be fixedly attached to the frame 110 by being formed as an integral component of the frame 110. The movable member's first end 222 is pivotally attached to the frame 110, and the movable member's second end 223 is releasably attached or coupled to the fixed member 225. In the embodiment shown in FIGS. 2-6, the movable member's first end 222 is indirectly attached to the frame 110 via a pivot bracket 228 and a bolt 229. In other embodiments, the movable member's first end 222 can be pivotally attached directly to one or more protrusions integral to the frame 110. The latch 220 is shown in the open position in FIG. 5. When in the open position, the fixed member 225 and the movable member 221 form an opening or mouth capable of receiving a primary horizontal scaffold member. The latch 220 is shown in the locked position in FIG. 4. When in the locked position, the fixed member 225 and the movable member 221 form an enclosed chamber which, in a preferred embodiment, is sized and shaped to snuggly engage the primary horizontal scaffold member. The latch 220 is secured in the locked position with a locking means, such as the pin 227. Both the movable member 221 and the fixed member 225 can have apertures. When these apertures are aligned, the pin 227 can protrude successively through these apertures, thereby securing the movable member 221 to the fixed member 225. The latch 220 can subsequently be opened by depressing the pin 227.

In the embodiment shown in FIGS. 2-7, the second mounting member 201 is a channel bracket 240. The channel bracket 240 functions to secure the intermediate scaffold joint 100 to a second primary horizontal scaffold member 901. In the preferred embodiment depicted in FIGS. 2-7, the channel bracket 240 is attached to the lower end of the frame's exterior side 114. The channel bracket 240 and frame 110 form a three-sided structure defining a channel or slot. The channel is adapted to receive a horizontal scaffold member. Although the channel's profile is depicted in FIG. 2 as a square-shaped channel, the channel can be formed in a variety of shapes (i.e., rounded) so long as it is capable of receiving a horizontal scaffold member.

The intermediate scaffold joint 100 of the present invention also features a means for attaching an intermediate scaffold member to the frame. The attachment means can be for attaching either an intermediate horizontal member or an intermediate vertical member. In the preferred embodiment depicted in FIGS. 2-7, the intermediate scaffold joint 100 features an attachment means for both an intermediate horizontal member and an intermediate vertical member.

As shown in FIGS. 2-7, a means for attaching an intermediate vertical member to the frame's top side includes the vertical stub 400. As shown in FIG. 2, the vertical stub 400 is attached to the frame's top side 115. The vertical stub 400 can be sized to be insertable into an intermediate vertical scaffold member (not shown), or alternatively, the vertical stub 400 can be sized such that an intermediate vertical scaffold member (not shown) is insertable into the vertical stub 400. The vertical stub 400 can also have a locking means for securing the intermediate vertical scaffold member to the vertical stub 400. The locking means can comprise a spring-loaded latch button or pin (not shown). When assembled, the spring-loaded latch button would protrude through aligned apertures in both the intermediate vertical scaffold member and the vertical stub 400 to secure both components to one another. The latch button could be depressed to disengage the components.

Figure 8:
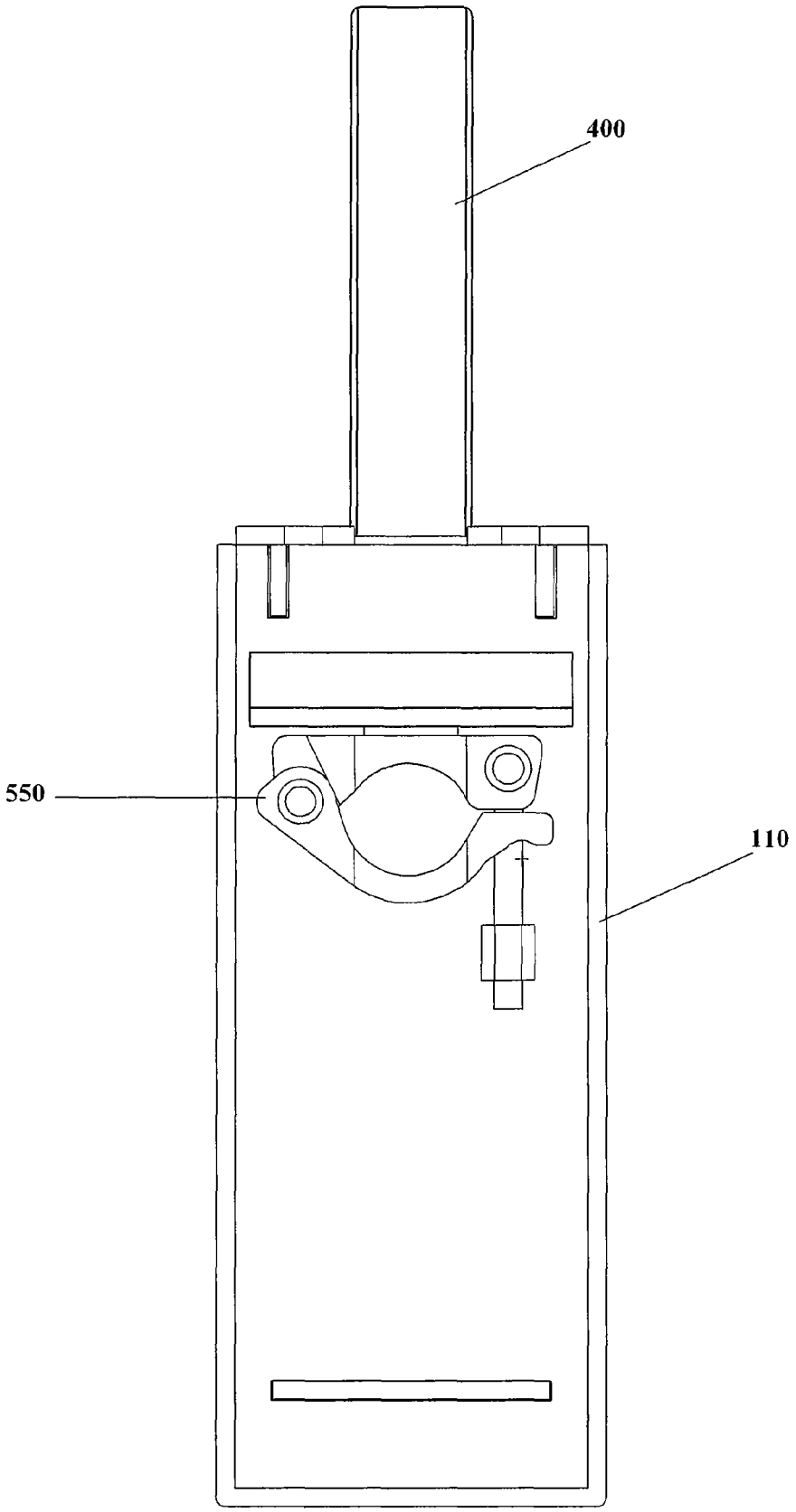
FIG. 8 is a front perspective view of an alternative embodiment showing the features on the interior side of the new intermediate scaffold joint.

A means for attaching an intermediate horizontal scaffold member to the frame's interior side includes one or more projections 500 extending from the frame's interior side 113. In the embodiment depicted in FIG. 7, the projections 500 are the ½ cup members or rings described in U.S. Pat. Nos. 5,028,164, 5,078,532, and 6,932,195. These ½ cup members are engaged by the Williams Latch Mechanism described in U.S. Pat. Nos. 5,028,164, 5,078,532, and 6,932,195, thereby securing the intermediate horizontal scaffold member to the joint 100. In an alternative embodiment shown in FIG. 8, the attachment means can comprise a clamp 550 similar to the one described in U.S. Pat. No. 6,932,195, thereby allowing the intermediate scaffold joint 100 to be used with intermediate horizontal members that lack the Williams Latch Mechanism. In a further alternative embodiment, the attachment means for an intermediate horizontal scaffold member can comprise a downwardly projecting plate with an opening therein adapted to accommodate an intermediate horizontal member, as shown and described in U.S. Pat. No. 6,932,195.

In operation, the preferred embodiment of the intermediate scaffold joint 100 can be utilized to attach both intermediate horizontal scaffold members and intermediate vertical scaffold members as follows. The joint 100 first must be mounted to an existing scaffold structure. In order to mount the joint 100, the latch 220 is brought to the open position by disengaging the movable member 221 from the fixed member 225. Once the latch 220 is in the open position, the channel bracket 130 is placed over the second horizontal scaffold member 901, and the first primary horizontal scaffold member 900 is placed within the mouth of the latch 220. The first horizontal scaffold member 900 can then be secured within the latch 220 by bringing the latch's movable member 221 to the closed position. The latch 220 is locked into the closed position by aligning the apertures in both the movable member 221 and the fixed member 225 and allowing the pin 227 to protrude successively through the apertures.

Figure 11:
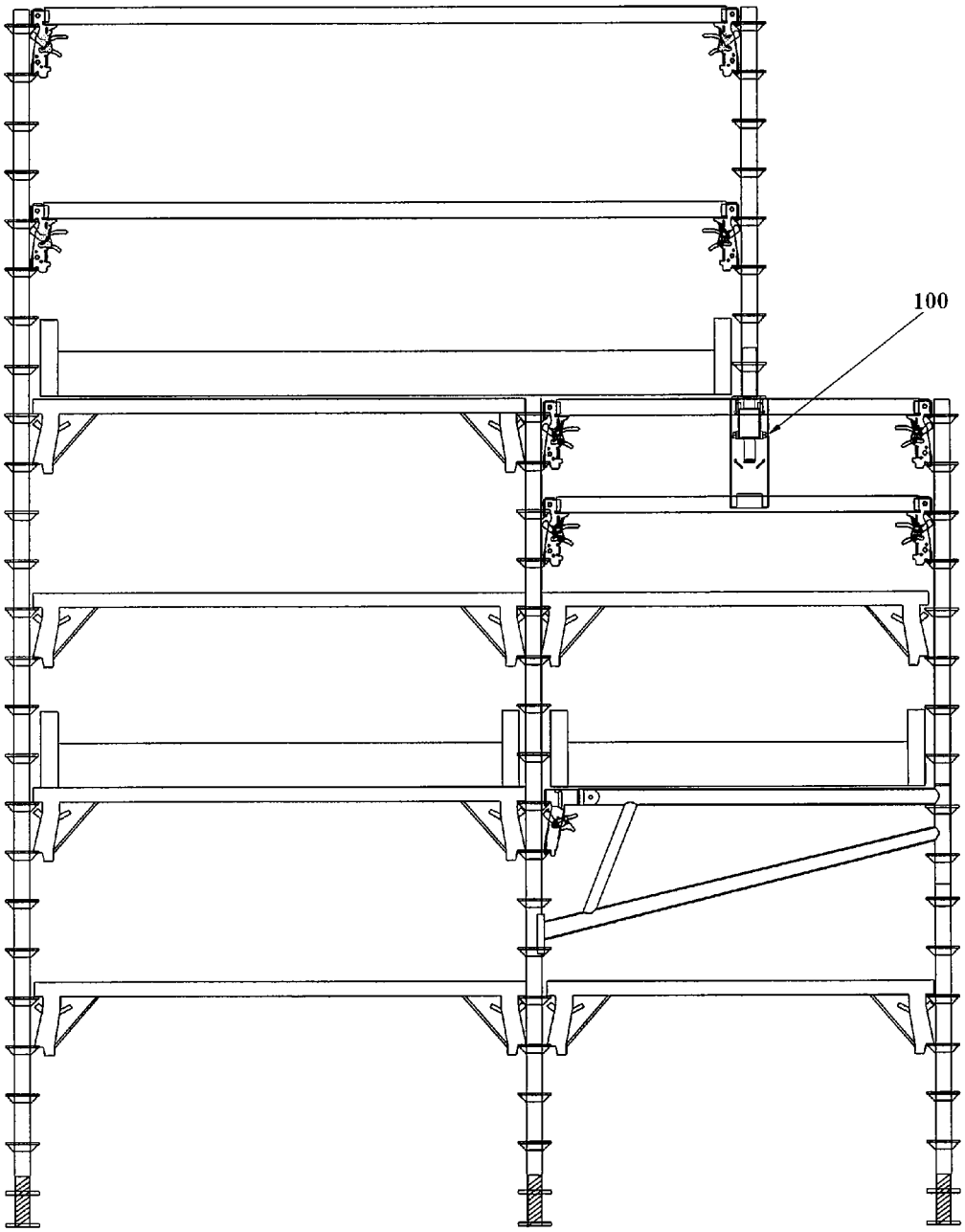
FIG. 11 is a front view of the preferred embodiment of the new intermediate scaffold joint attached to an existing scaffold structure.

FIG. 11 depicts the joint 100 mounted to an existing scaffold structure. Once the joint 100 is mounted to the scaffold structure, the joint 100 will not rotate about either horizontal scaffold member due to the dual attachments points. A user can now add either an intermediate vertical member or an intermediate horizontal member, or both. An intermediate vertical member can be attached to the joint 100 by sliding the intermediate vertical member over the vertical stub 400 (or in an alternative configuration, by sliding the intermediate vertical member into the vertical stub 400). The intermediate vertical member can be secured to the vertical stub 400 via the latch button. Alternatively or in conjunction with the intermediate vertical member, an intermediate horizontal member can be attached to the joint 100. In the preferred embodiment, an intermediate horizontal member having a Williams Latch Mechanism engages the frame's projections 500, thereby securing the intermediate horizontal member to the joint 100. An alternative embodiment of the joint 100 featuring a clamp in lieu of the projections 500 can be used where the intermediate horizontal member does not possess the Williams Latch Mechanism. In this alternative embodiment (See FIG. 8), the end of the intermediate horizontal member is placed within the clamp's opening. The clamp is then tightened, thereby securing the intermediate horizontal member to the joint 100.

Figure 9:
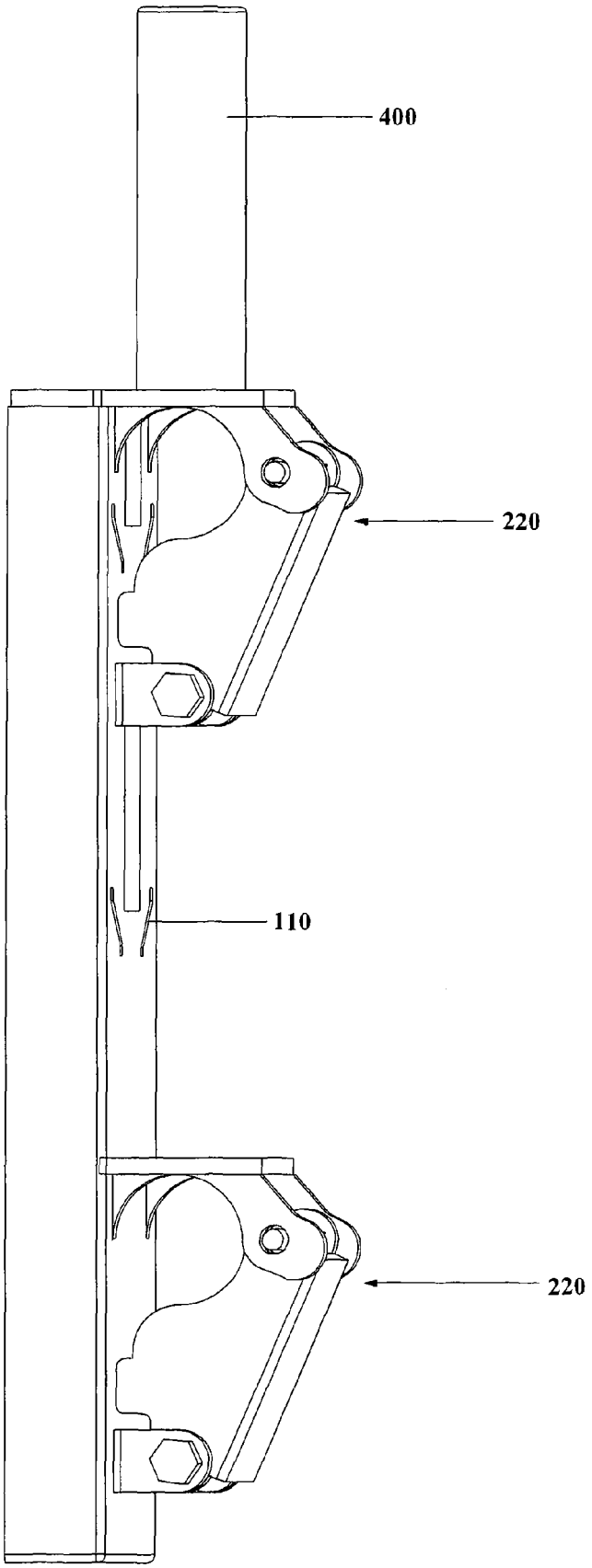
FIG. 9 is a rear perspective view of an alternative embodiment showing the features on the exterior side of the new intermediate scaffold joint.
Figure 10:
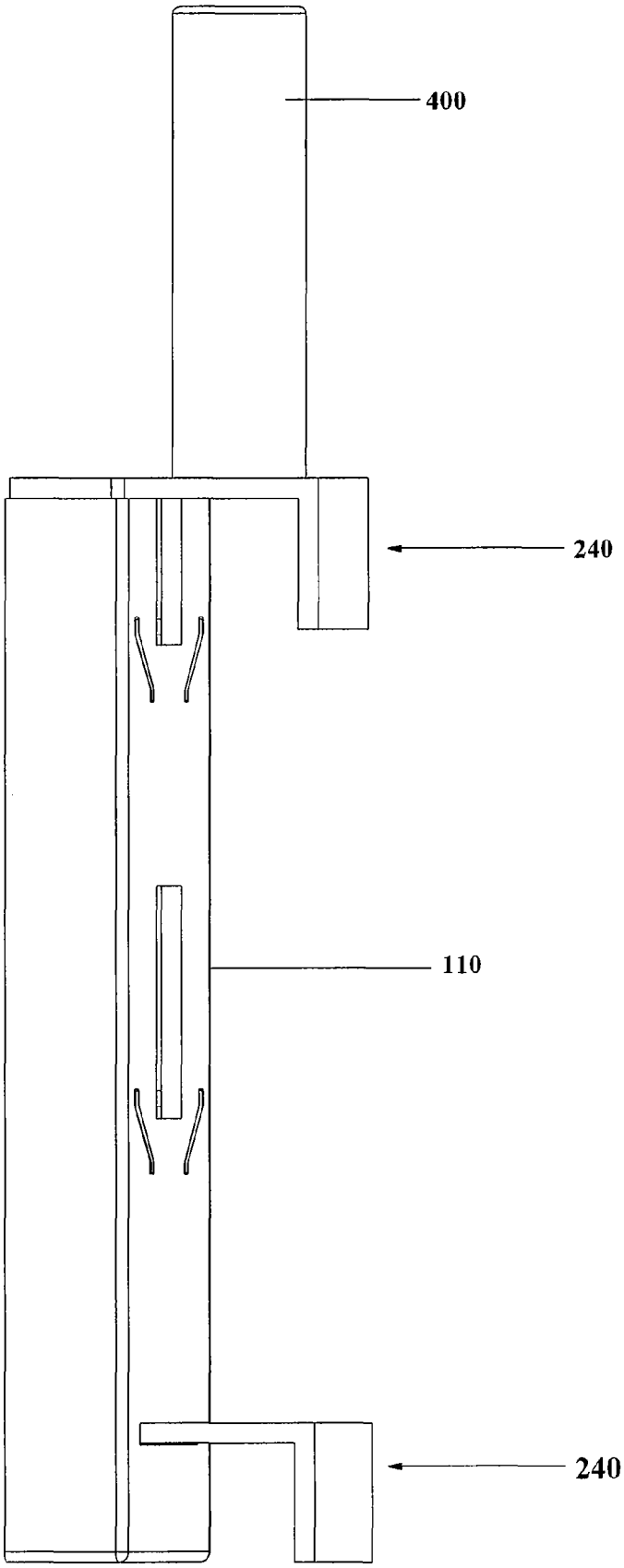
FIG. 10 is a rear perspective view of an alternative embodiment showing the features on the exterior side of the new intermediate scaffold joint.

Many modifications and other embodiments of the inventions set forth herein will come to mind to one skilled in the art after having the benefit of the teaching presented in the foregoing descriptions and the associated drawings. For instance, in an alternative embodiment, the latch 220 can be attached to the frame's lower end, with the channel bracket 240 being attached to the frame's upper end. Additionally, as shown in FIG. 9, two latches 220 could be used in lieu of the channel bracket 240, or as shown in FIG. 10, two channel brackets 240 could be used in lieu of the latch 220. Furthermore, although the locking means for the latch 220 is a pin in the embodiment depicted in FIGS. 2-7, other known mechanisms useful for releasably attaching two components, such as a bolt and nut, may be employed. In summary, it should be understood that the invention disclosed herein is not to be limited to the specific embodiments disclosed and that modifications and other embodiments are intended to be included within the scope of the appended claims. Although specific terms may be employed herein, they are used in a generic and descriptive sense only and not for purposes of limitation.

What is claimed is:

1. An intermediate scaffold joint comprising:

a. A frame having an interior side, an exterior side directly opposite the interior side, and a top side;

b. A first mounting member attached to the frame's exterior side along a vertical plane at a first position, and a first primary scaffold horizontal member removably coupled to said first mounting member at a first location on said first primary horizontal scaffold member, where said first primary horizontal scaffold member has a first and second terminating ends, and said first location is located intermediary said first and second terminating ends of said first primary horizontal scaffold member;

c. A second mounting member attached to the frame's exterior side at a second position spaced apart vertically along the vertical plane from the first position, and a second primary scaffold member removably coupled to said second mounting member at a second location on said second primary scaffold member, where said second primary horizontal scaffold member has a first and second terminating ends, and said second location is located intermediary said first and second terminating ends of said second primary scaffold member; where said coupled first primary horizontal scaffold member and said coupled second primary horizontal scaffold members are substantially parallel;

d. A vertical stub attached to the frame's top side for attaching an intermediate vertical scaffold member;

e. and a first, second and third vertical scaffold member, said first vertical scaffold member removably coupled to said first terminating end of said first and second primary horizontal scaffold members; said second vertical scaffold member removably coupled to said second terminating end of said first and second primary horizontal scaffold members, and said third vertical scaffold member removably coupled to said vertical stub.

2. The intermediate scaffold joint of claim 1, further comprising one or more projections extending from the frame's interior side for attaching an intermediate horizontal scaffold member.

3. The intermediate scaffold joint of claim 1, further comprising a clamp extending from the frame's interior side for attaching an intermediate horizontal scaffold member.

4. The intermediate scaffold joint of claim 1, wherein the first mounting member is a latch and the second mounting member is a channel bracket.

5. The intermediate scaffold joint of claim 4, wherein the latch comprises:

a. A fixed member; and b. A movable member having a first end and a second end, wherein the movable member's first end is pivotally attached to the frame; and c. A locking means for releasably coupling the movable member's second end to the fixed member.

6. The intermediate scaffold joint of claim 5, wherein the locking means is a pin.

7. The intermediate scaffold joint of claim 1, wherein the first mounting member and the second mounting member are both latches.

8. The intermediate scaffold joint of claim 7, wherein the latches each comprise:

a. A fixed member; and b. A movable member having a first end and a second end, wherein the movable member's first end is pivotally attached to the frame; and c. A locking means for releasably coupling the movable member's second end to the fixed member.

9. The intermediate scaffold joint of claim 8, wherein the locking means is a pin.

10. The intermediate scaffold joint of claim 1, wherein the first mounting member and the second mounting member are both channel brackets.

* * * * *